US009732485B2

(12) United States Patent
McCue et al.

(10) Patent No.: US 9,732,485 B2
(45) Date of Patent: Aug. 15, 2017

(54) COLUMN PROTECTOR

(71) Applicant: McCue Corporation, Peabody, MA (US)

(72) Inventors: David S. McCue, Manchester, MA (US); Timothy David Stratford, Buckinghamshire (GB); Steve Field, Ogunquit, ME (US); David DiAntonio, Andover, MA (US); Thomas Ustach, Revere, MA (US)

(73) Assignee: MCCUE CORPORATION, Peabody, MA (US)

( * ) Notice: Subject to any disclaimer, the term of this patent is extended or adjusted under 35 U.S.C. 154(b) by 0 days.

(21) Appl. No.: 15/006,574

(22) Filed: Jan. 26, 2016

(65) Prior Publication Data

US 2016/0215464 A1 Jul. 28, 2016

Related U.S. Application Data

(60) Provisional application No. 62/107,102, filed on Jan. 23, 2015.

(51) Int. Cl.
*E01F 15/14* (2006.01)
*E04C 3/36* (2006.01)

(52) U.S. Cl.
CPC ..... *E01F 15/141* (2013.01); *E04C 3/36* (2013.01)

(58) Field of Classification Search
CPC .. E01F 15/141; E04C 3/00; E04C 3/30; E04C 3/36; E04H 12/2292
See application file for complete search history.

(56) References Cited

U.S. PATENT DOCUMENTS 1,517,846 A * 12/1924 Lewis ..... E04H 12/2292 174/136
5,006,386 A * 4/1991 Menichini ..... E01F 15/0469 138/118.1
5,956,920 A * 9/1999 Davis ..... E04C 3/30 52/236.1
6,242,070 B1 * 6/2001 Gillispie ..... E01F 15/141 428/122
6,712,546 B1 * 3/2004 Radu, Jr. ..... B28B 7/0014 404/8
2001/0022056 A1 * 9/2001 Gifford ..... E04F 13/0736 52/311.1
2003/0000152 A1 * 1/2003 Ryan ..... E01F 15/0469 52/3
2006/0010823 A1 * 1/2006 Waters ..... E04C 3/30 52/834
2007/0193203 A1 * 8/2007 Prenn ..... E04H 12/2292 52/835

(Continued)

FOREIGN PATENT DOCUMENTS

DE 102010009814 9/2011
GB 2534925 8/2016

*Primary Examiner* — Rodney Mintz
(74) *Attorney, Agent, or Firm* — Occhiuti & Rohlicek LLP

(57) ABSTRACT

A column protection apparatus includes a number of impact absorbing members, each impact absorbing member including a protrusion and a protrusion receiving opening. The protrusion of each impact absorption member is inserted into the protrusion receiving opening of another, different impact absorption member such that a column-receiving opening is formed through the impact absorbing members.

16 Claims, 10 Drawing Sheets

(56) References Cited

U.S. PATENT DOCUMENTS

| | | | | |
|---|---|---|---|---|
| 2009/0025336 | A1* | 1/2009 | Prenn | E04H 12/2292 52/835 |
| 2009/0126298 | A1* | 5/2009 | Salcedo | E04H 12/2292 52/288.1 |
| 2012/0324826 | A1* | 12/2012 | Petta | E04C 3/30 52/834 |
| 2014/0182226 | A1* | 7/2014 | Habodasz | E04F 13/0736 52/309.1 |
| 2015/0167311 | A1 | 6/2015 | Mingyong et al. | |
| 2015/0259866 | A1* | 9/2015 | McCue | E04H 17/14 256/21 |
| 2016/0222648 | A1* | 8/2016 | Ryan | E04B 1/92 |
| 2016/0244965 | A1* | 8/2016 | Lu | E04C 3/29 |

* cited by examiner

COLUMN PROTECTOR

CROSS-REFERENCE TO RELATED APPLICATIONS

This application claims the benefit of U.S. Provisional Application No. 62/107,102 filed Jan. 23, 2015, which is incorporated by reference.

BACKGROUND

This invention relates to a column protector for an industrial facility.

Warehouses, distributions centers, factories, and similar facilities often have large stock handling equipment such as fork trucks which frequently move stock into, out of, and around the facility. In some examples, facilities may have columns (e.g., support columns) which are located in areas commonly traversed by the stock handling equipment.

SUMMARY

As an operator navigates stock handling equipment through a facility, it is possible for the operator to cause the equipment to collide with a support column, potentially causing damage to the column and/or the equipment.

In a general aspect, a column protection apparatus includes a number of impact absorbing members, each impact absorbing member including a protrusion and a protrusion receiving opening. The protrusion of each impact absorption member is inserted into the protrusion receiving opening of another, different impact absorption member such that a column-receiving opening is formed through the impact absorbing members.

Aspects may include one or more of the following features.

At least some of the protrusions of the impact absorption members may be partially inserted into a protrusion receiving opening of another, different impact absorption member. Each impact absorbing member may include one or more grooves for receiving a portion of a securing strap. A top surface of each impact absorbing member may have a rounded shape. Each impact absorbing member may be substantially L-shaped. The protrusion of each impact absorbing member may include a protrusion alignment member and the protrusion receiving opening of each impact absorbing member may include an opening alignment member configured to interact with the protrusion alignment member to align the protrusion in the protrusion opening. The protrusion alignment member may include a groove and the opening alignment member may include a groove configured to receive the groove to align the protrusion in the protrusion opening.

At least one of the impact absorbing members may include a recess for accommodating a strap tightening tool. The impact absorbing apparatus may include a proximity sensing alarm for alerting approaching vehicles of an impending collision with the impact absorbing apparatus. The impact absorbing apparatus may include a rotatable outer shell for impact deflection. The impact absorbing members may be formed from a high density polyethylene (HDPE) material. One or more of the impact absorbing members may include a strengthening rib on an outer surface thereof.

Aspects may have one or more of the following advantages.

Among other advantages, the adjustable column protector is configured for snug and secure installation onto a wide range of column sizes.

The adjustable column protector is easily installed and offers 360 degree protection of a column from collisions.

The adjustable column protector provides damage prevention in that it protects the column, protects the equipment that hits may hit a column, it protects equipment operators, and it avoids scratching equipment and the associated equipment repainting.

The adjustable column protector can be used indoors or outdoors.

The adjustable column protector is abrasion resistant.

Other features and advantages of the invention are apparent from the following description, and from the claims.

DESCRIPTION

Figure 1:
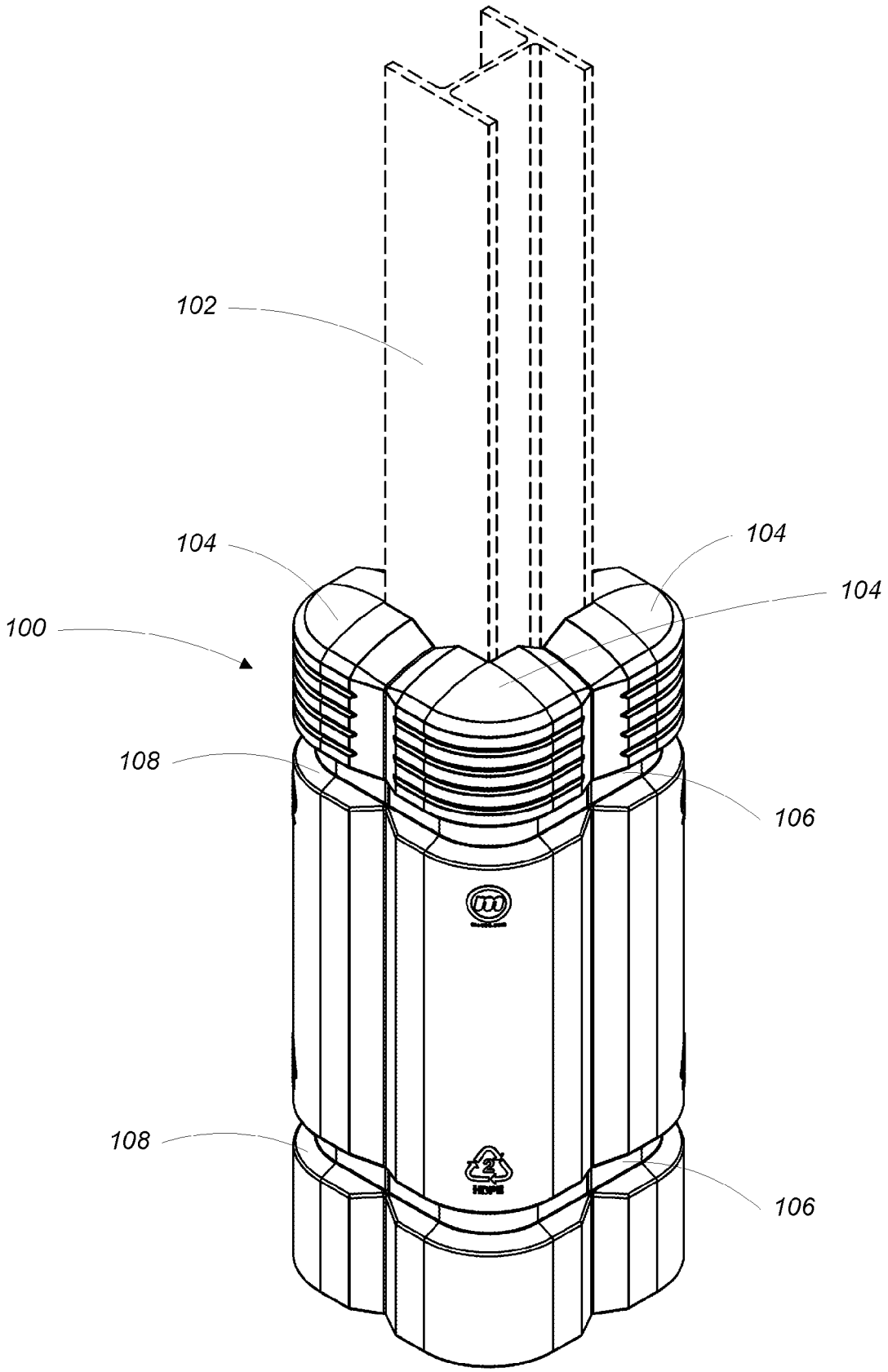
FIG. 1 is a perspective view of a first configuration of an adjustable column protector.

Referring to FIG. 1, an adjustable column protector 100 is installed on a column 102 (e.g., an I-beam support column). The adjustable column protector 100 includes four corner sections 104 (with only three visible in FIG. 1), sometimes referred to as 'impact absorbing members,' nested within one another such that a portion of the column 102 is fully enveloped by the adjustable column protector 100. The column protector 100 covers and protects both the corners and the sides of the portion of the column 102.

As is described in greater detail below, the column protector 100 can be adjusted to closely fit any column that has a size within a predetermined range (e.g., 8" to 12" columns) while still maintaining coverage and protecting both the corners and the sides of the portion of the column 102.

In some examples, the four corner sections 104 are held together using one or more straps 106 (e.g., ratchet ties, Velcro straps, cam straps, etc.) that are disposed in one or more grooves 108 of the corner sections 104.

Figure 2:
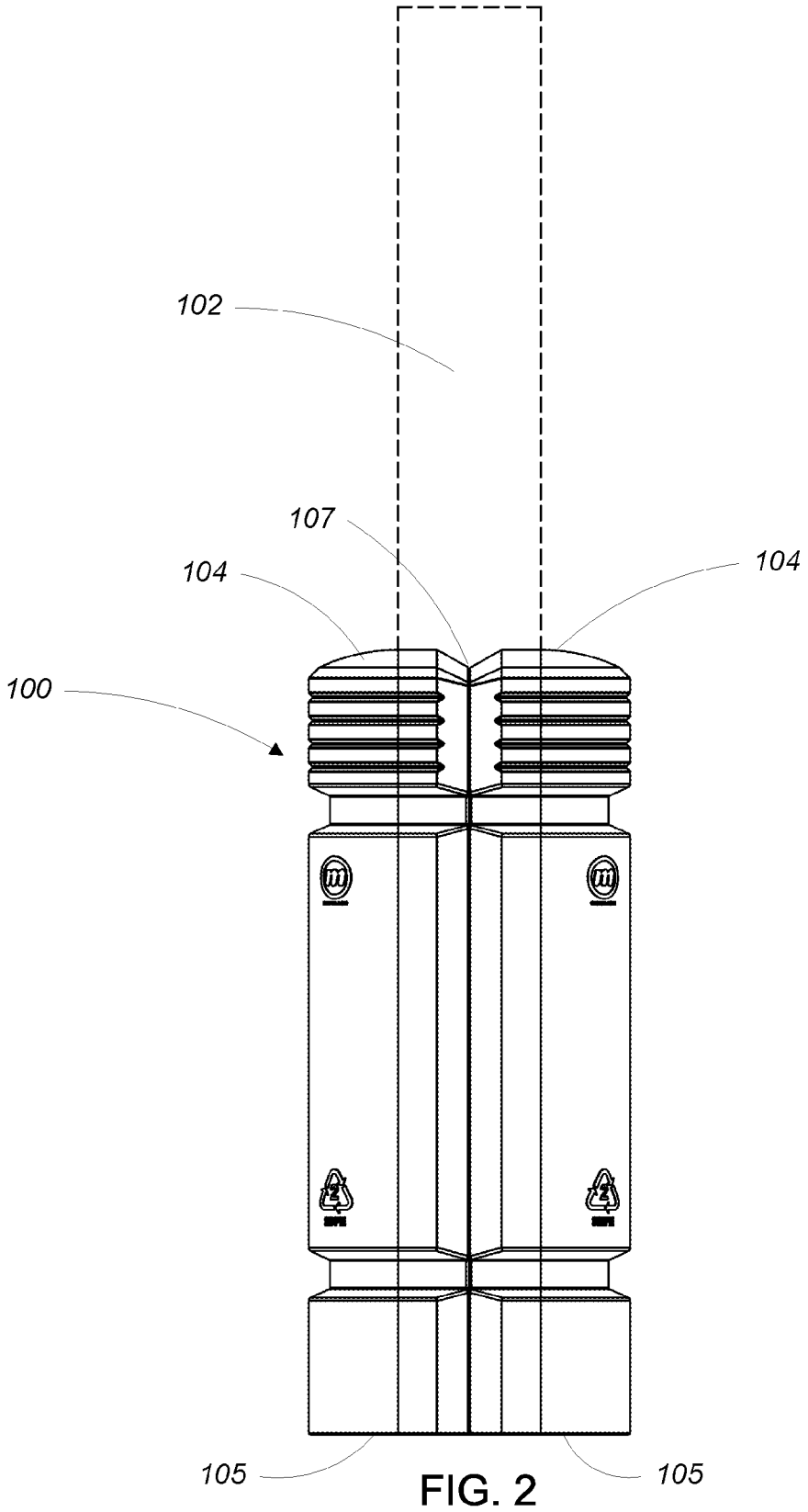
FIG. 2 is a side view of the adjustable column protector of FIG. 1.

Referring to FIG. 2, a side view of the adjustable column protector 100 shows two corner sections 104 abutting one another at a central plane 107. In this configuration, the column protector is adjusted to its smallest size (e.g., to fit an 8" column). Each of the corner sections 104 has a flat bottom surface 105 such that the column protector 100 rests flatly on the ground.

Figure 3:
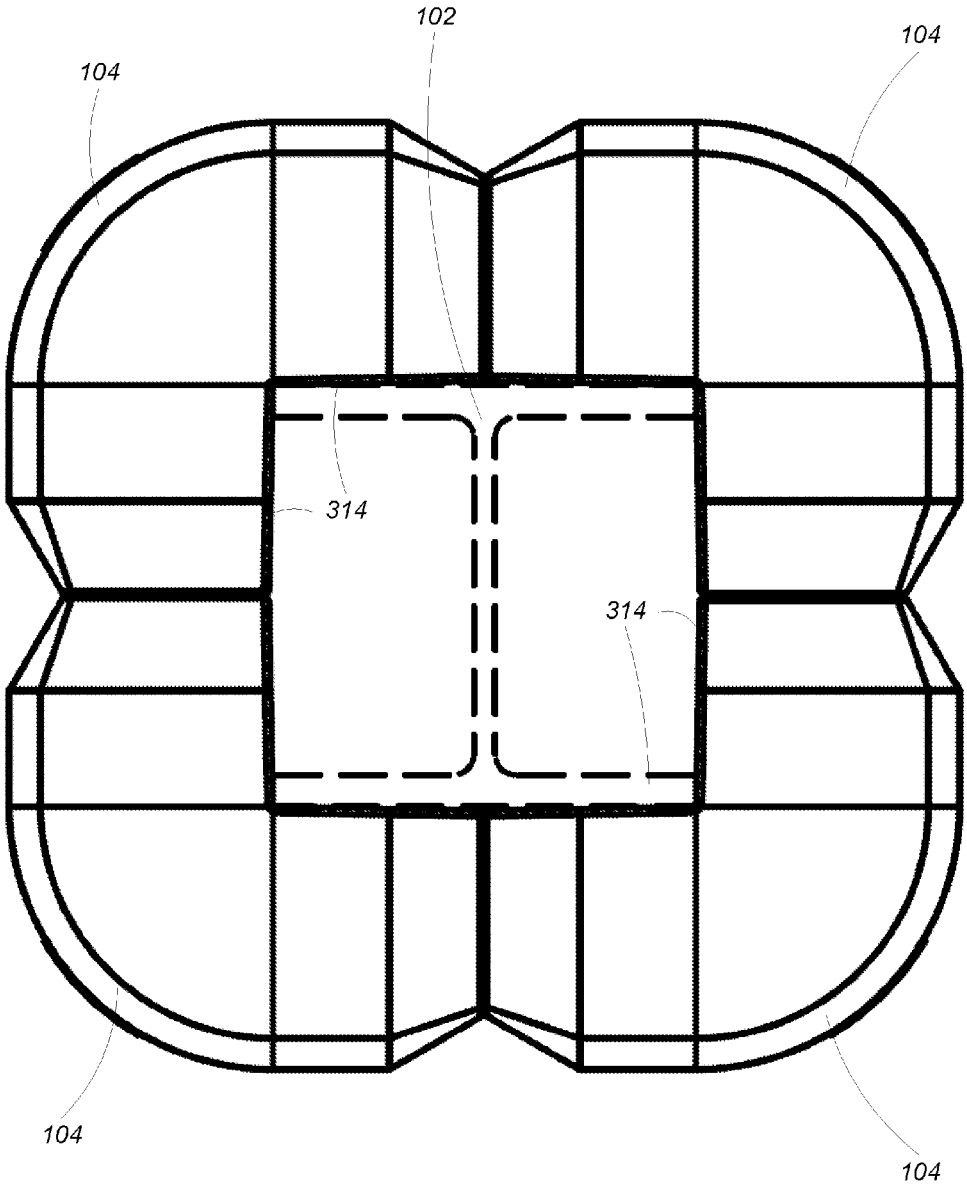
FIG. 3 is a top view of the adjustable column protector of FIG. 1.

Referring to FIG. 3, a top view of the adjustable column protector 100 shows the four corner sections 104 adjusted to closely fit the column 102, with little or no clearance between the column and the inner surfaces 314 of corner sections 104.

Figure 4:
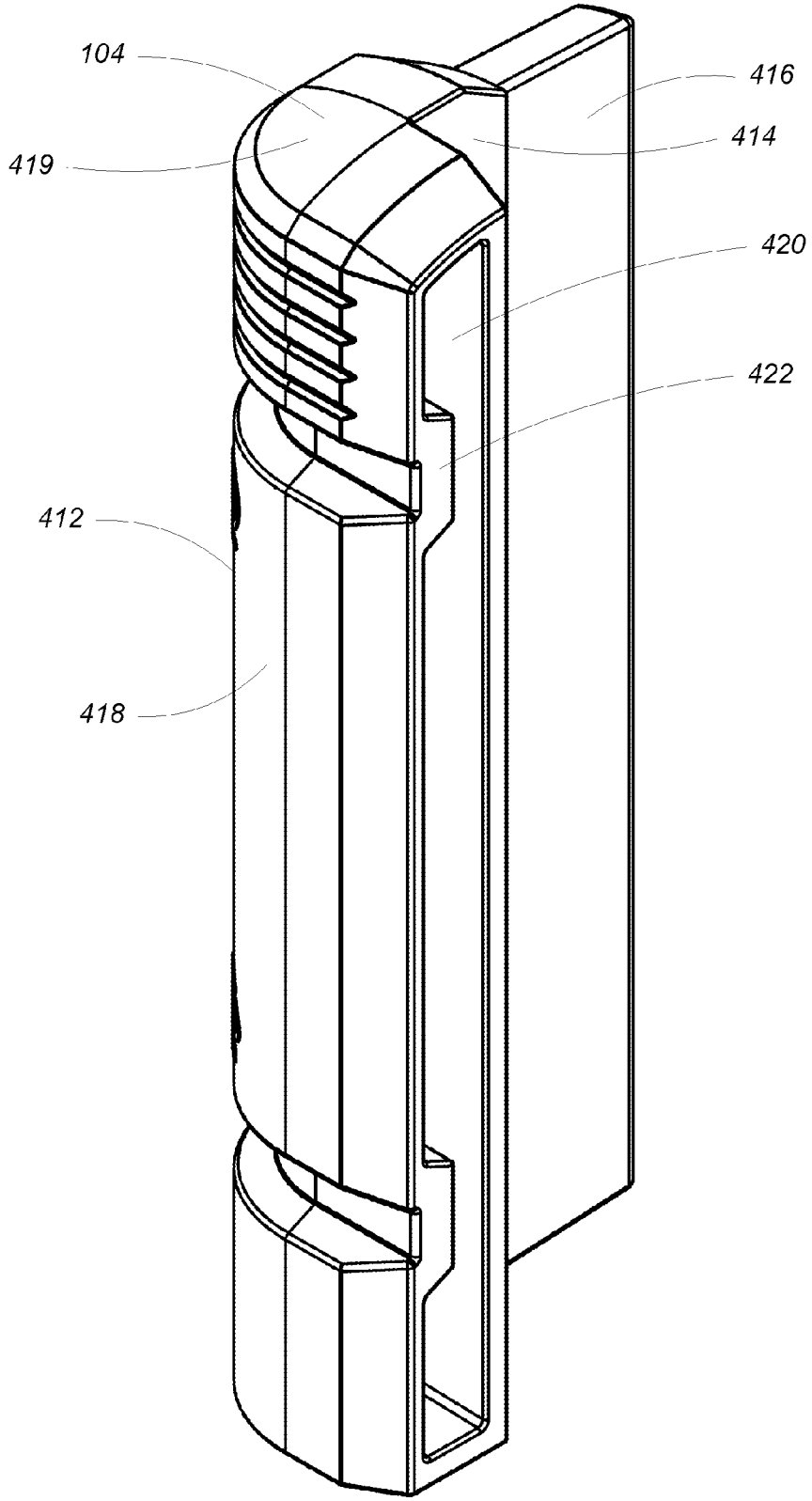
FIG. 4 is a rear-perspective view of a corner section of the adjustable column protector.

Referring to FIG. 4, each corner section 104 is a substantially L-shaped member having an outer surface 412, an inner surface 414, a protrusion 416, and a bumper 418 having a top surface 410 including a protrusion receiving slot 420.

In some examples, the outer surface 412 has a rounded shape for increased impact deflection. The inner surface 414 forms a right angle and is configured to rest against the column 102 when the adjustable column protector 100 is installed. The bumper 418 is configured to face away from the column 102 and to protect the corner of the column from the force of collisions with stock handling equipment. In some examples, the top surface 410 of the bumper 418 is rounded to prevent accumulation of debris and liquids (e.g., water).

In general, the protrusion 416 of each corner section 104 is configured for partial or full insertion into the protrusion receiving slot 420 of another, different corner section 104. Similarly, the protrusion receiving slot 420 of each corner section 104 is configured for partially or fully receiving the protrusion 416 of another, different corner section 104. In some examples, each corner section 104 is identical.

When the protrusion 416 is only partially inserted into the protrusion receiving slot 420 (e.g., when installed on a larger column), the sides of the column 102 are covered and protected by the protrusion 416.

In some examples, the protrusion receiving slot 420 includes one or more alignment ridges 422 for ensuring proper alignment of the corner sections 104 when the protrusion 416 of one corner section 104 is inserted into the protrusion receiving slot 420 of another corner section.

Figure 5:
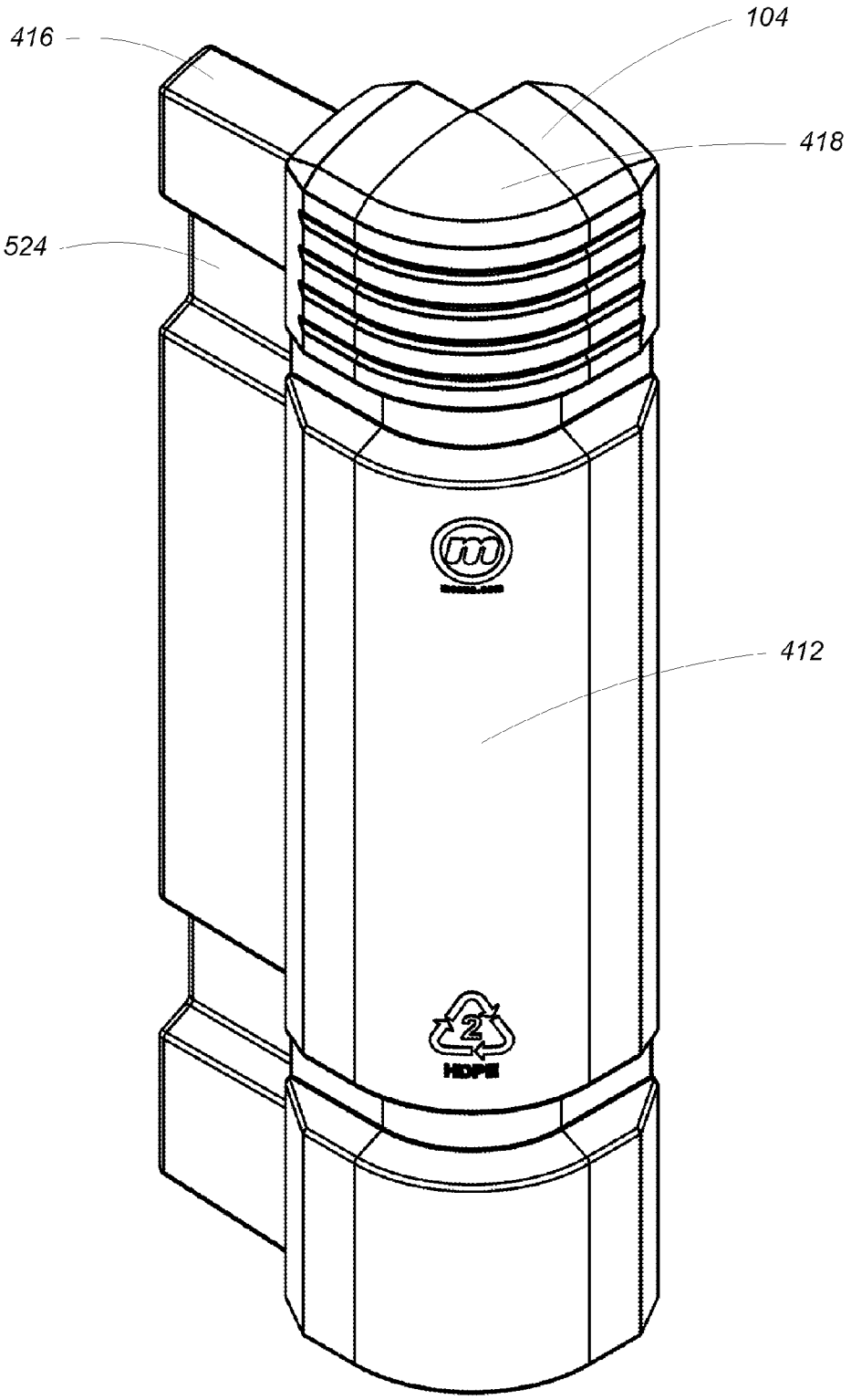
FIG. 5 is a front-perspective view of the corner section of FIG. 4.

Referring to FIG. 5, in some examples, the protrusion 416 includes one or more alignment grooves 524 for receiving the alignment ridges 422 of the protrusion receiving slot 420 of another corner section 104 in order to ensure proper alignment of the two corner sections 104 when assembled.

Figure 6:
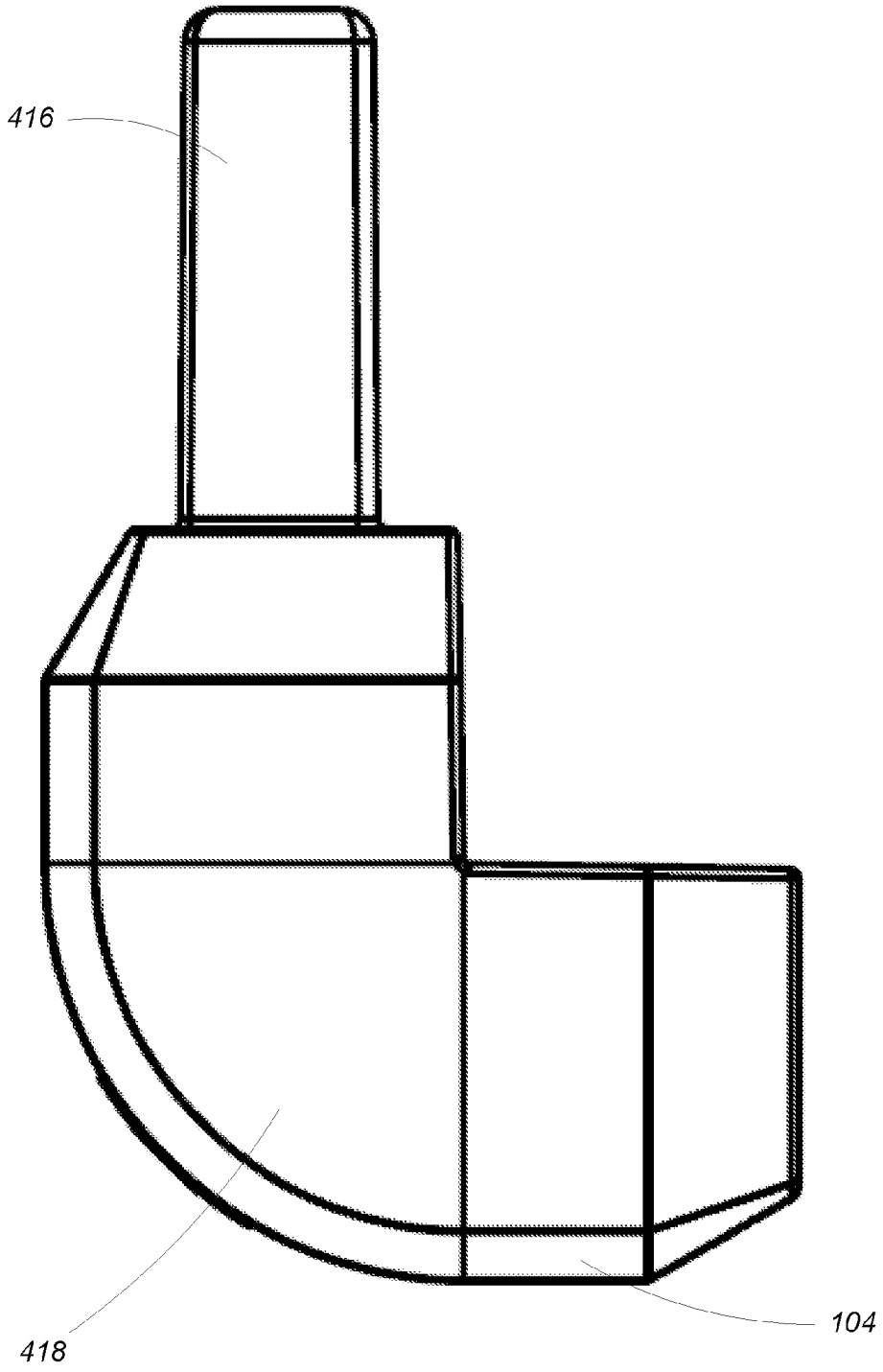
FIG. 6 is a top view of the corner section of FIG. 4.

Referring to FIG. 6, a top view of the corner section 104 shows the substantial L-shape of the member as well as the relative thicknesses of the protrusion 416 and the bumper 418.

Figure 7:
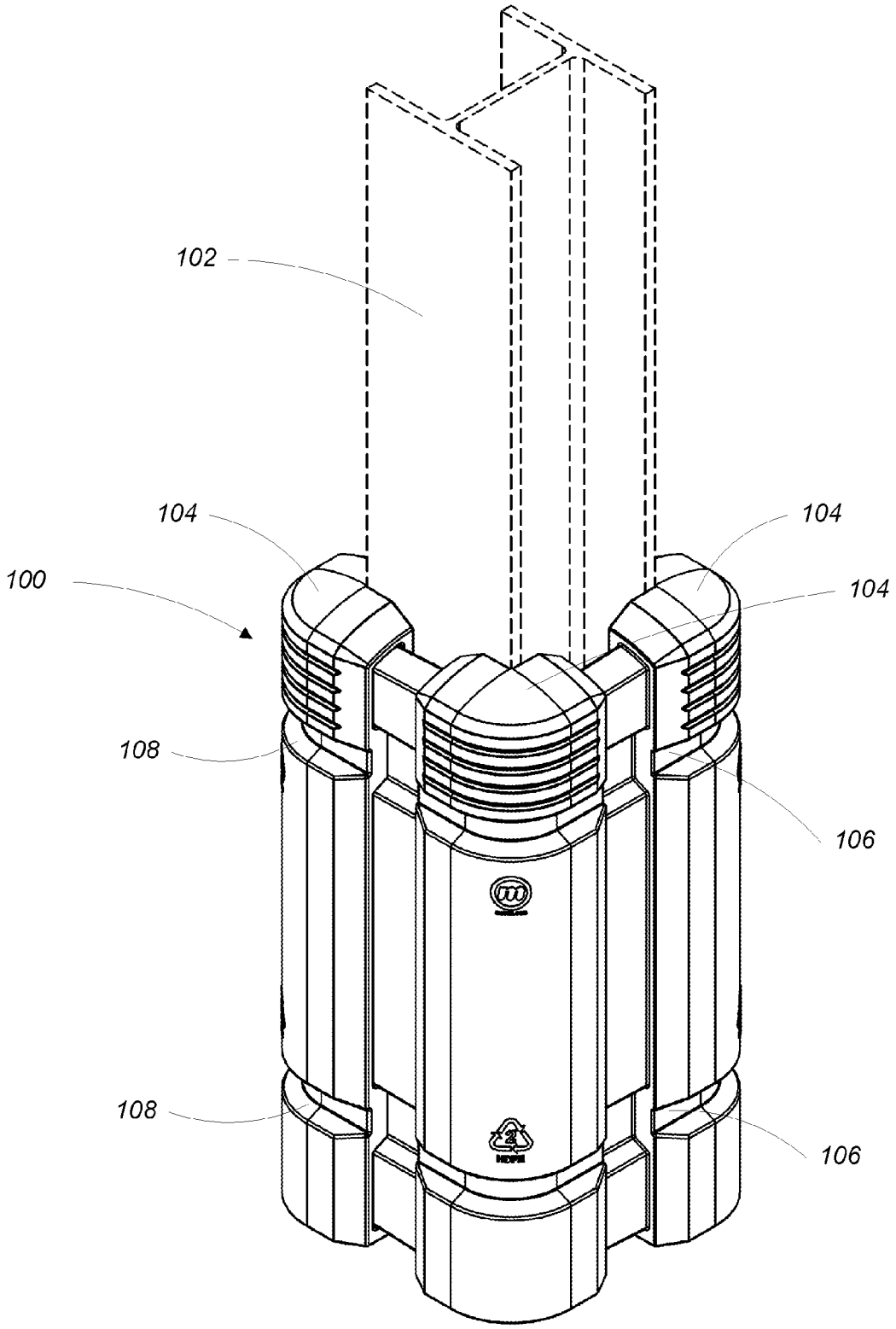
FIG. 7 is a perspective view of a second configuration of the adjustable column protector.

Referring to FIG. 7, when the adjustable column protector 100 is installed, the four corner sections 104 are assembled such that each corner section 104 has its protrusion 416 in the protrusion receiving slot 420 of another, different corner section 104. Similarly, each corner section 104 has the protrusion 416 of another, different corner section 104 in its protrusion receiving slot 420. In general, the degree to which the protrusions 416 are inserted into the protrusion receiving slots 420 depends on the dimensions of the column 102.

In FIG. 7, since the adjustable column protector 100 is installed on a larger column (e.g., an 11" column), the protrusions 416 of the corner sections 104 are only partially inserted into the protrusion receiving slots 420 of the other corner sections 104. However, the portion of the column 102 is still fully enveloped by the adjustable corner guard 100, with the protrusions covering the sides of the portion of the column 102 and the bumpers 418 covering the corners of the portion of the column 102.

Figure 8:
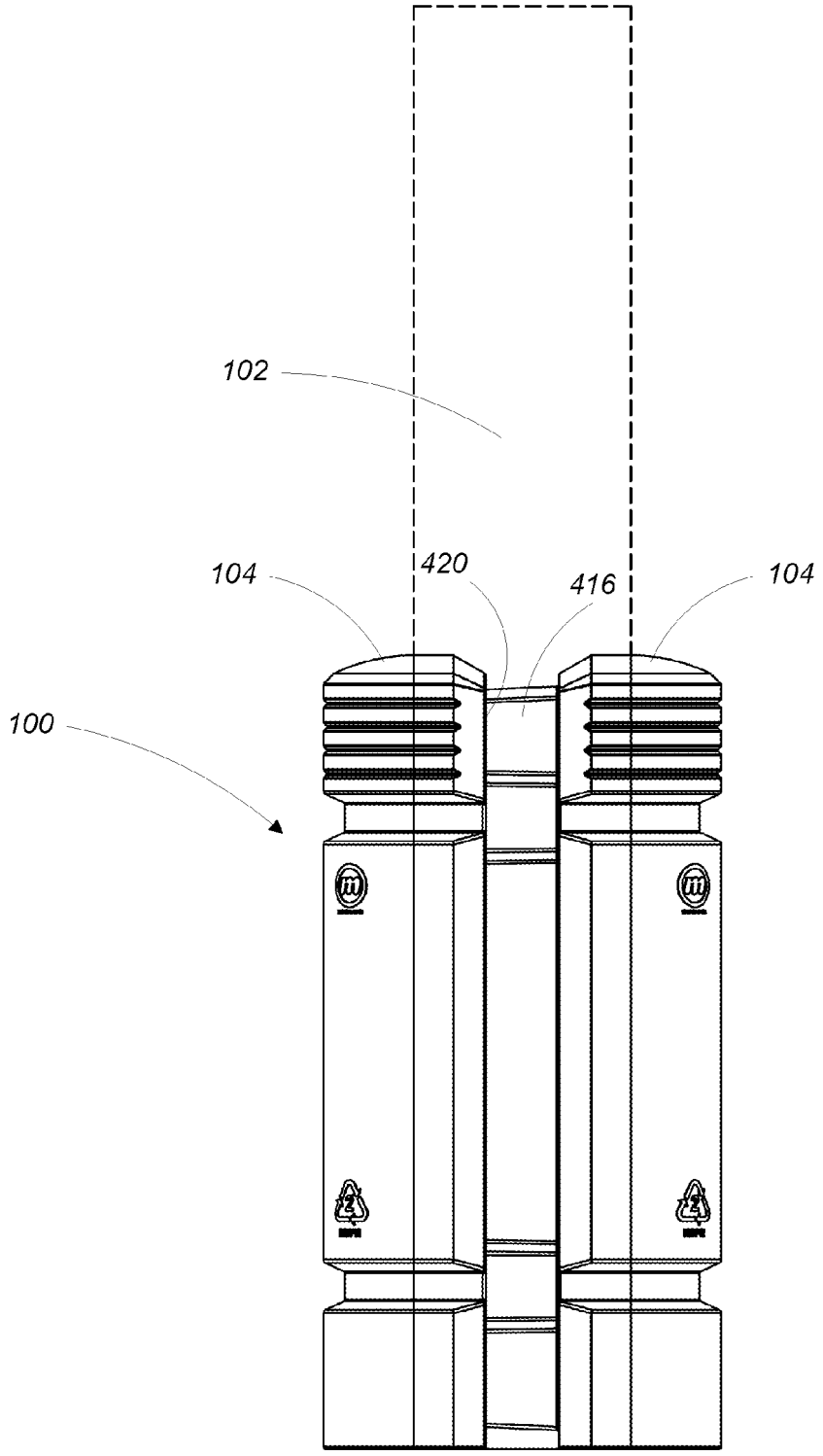
FIG. 8 is a side view of the adjustable column protector of FIG. 7.

Referring to FIG. 8, a side view of the adjustable column protector 100 shows two corner sections 104 with the protrusion 416 of one corner section 104 partially inserted into the protrusion receiving slot 420 of another corner section. In this configuration, the column protector is adjusted to a larger size, to fit a larger column 102 (e.g., an 11" column).

Figure 9:
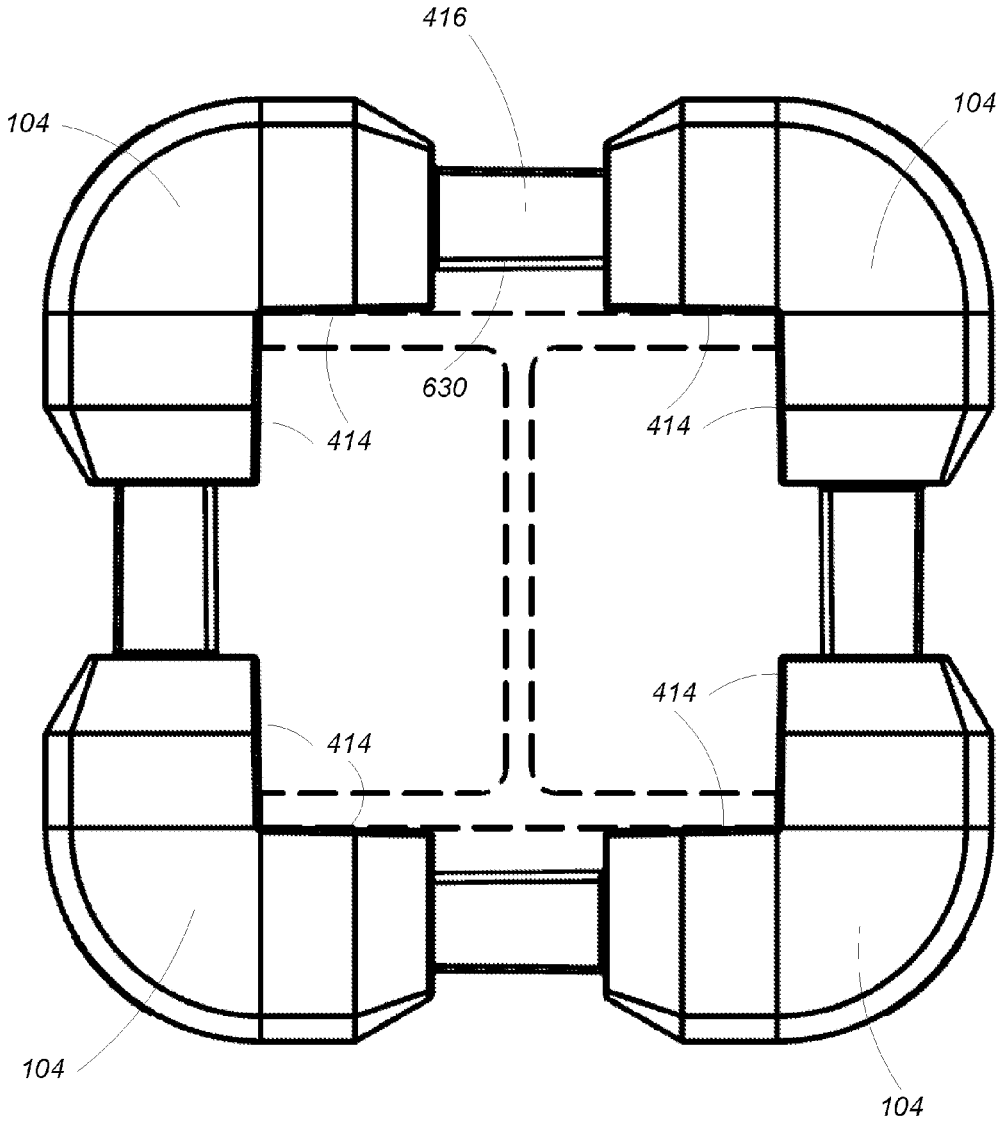
FIG. 9 is a top view of the adjustable column protector of FIG. 7.

Referring to FIG. 9, a top view of the adjustable column protector 100 shows the four corner sections 104 adjusted to have the inner surfaces 414 of the bumpers 418 closely fit the column 102, with little or no clearance between the corners of the column and the inner surfaces 418. In some examples, a space exists between the sides of the column 102 and the inner surfaces 630 of the protrusions 416.

Figure 10:
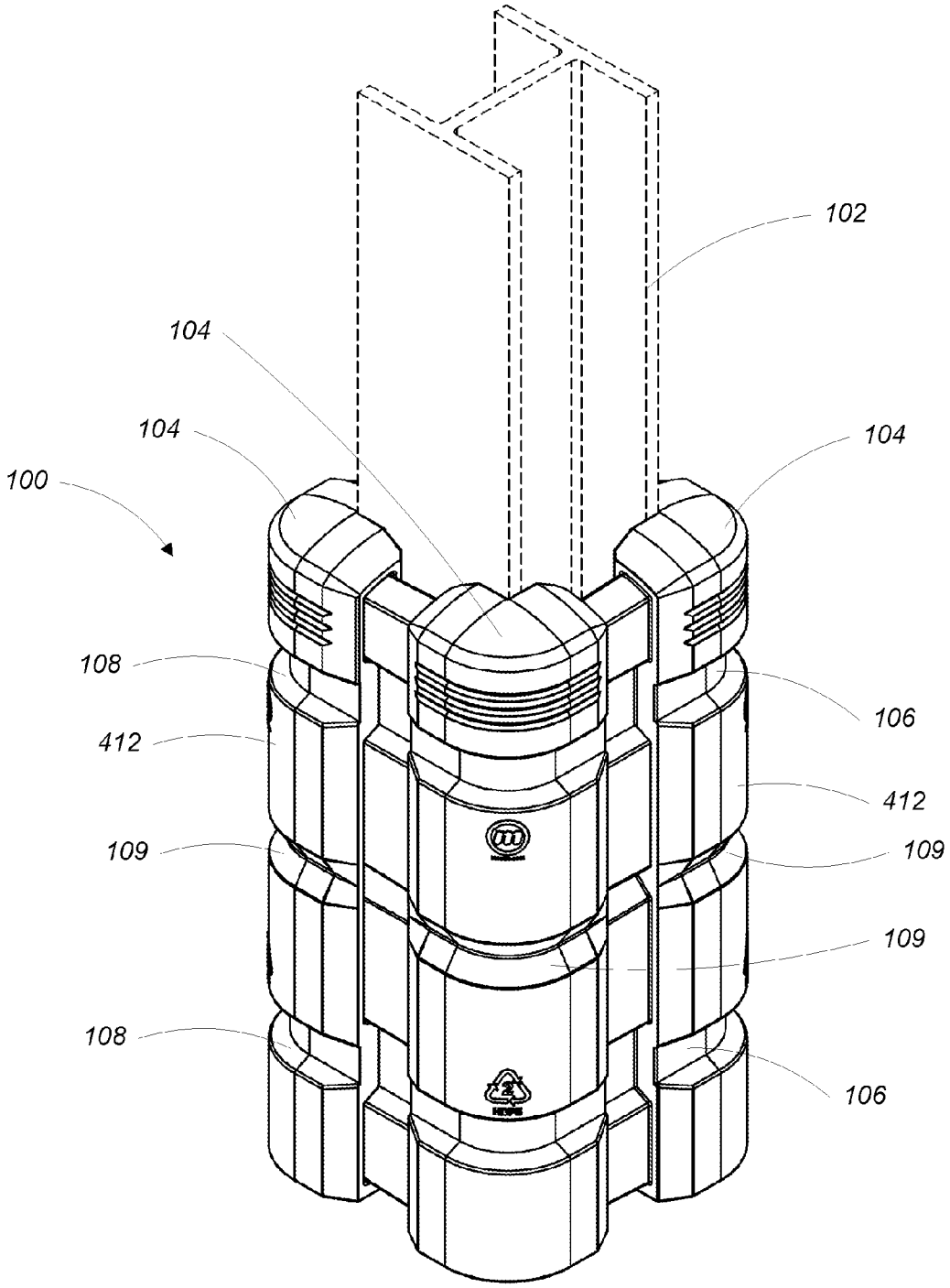
FIG. 10 is a front perspective view of a third configuration of an adjustable column protector.

Referring to FIG. 10, another example of an adjustable column protector 100 is installed on a column 102. The adjustable column protector includes four corner sections 104 (as is the case in the examples described above) nested within one another such that a portion of the column 102 is fully enveloped by the adjustable column protector 100. One or more of the corner sections 104 includes a strengthening rib 109 on its outer surface 412. In general, the strengthening ribs 109 increase the rigidity of the corner sections 104 and provide an alternative aesthetic appearance for the column protector 100.

In some examples the corner sections are made from a plastic material such as high density polyethylene (HDPE).

In some examples, a strap tightening tool can be used to tighten the straps 106 and secure the adjustable column protector 100 onto a column 102. In some examples the adjustable column protector 100 includes recesses for accommodating such a tool during a tightening process.

In some examples, all surfaces of the column protector, including surfaces other than the top surface 419 of the bumper 418, are shaped to ensure that liquids and debris shed off of the column protector.

In some examples, the column protector includes an exterior shell that can rotate upon impact in order to further dissipate the force of collisions.

In some examples, the column protector includes a proximity sensing alarm for warning equipment operators of an impending collision.

In some examples, extender members, each having a substantially planar shape, have an opening configured to receive a protrusion 416 of one of the corner sections 104 and a protrusion configured for insertion into a protrusion receiving slot 420 another of the corner sections 104. Such planar extender members serve to protect columns or other objects whose dimensions preclude the use of corner sections 104 alone.

While the above column protector is described as having only four corner sections 104, in some examples, a similar design using more or fewer corner sections can be used for other column shapes.

It is to be understood that the foregoing description is intended to illustrate and not to limit the scope of the invention, which is defined by the scope of the appended claims. Other embodiments are within the scope of the following claims.

What is claimed is:

1. A column protection apparatus comprising:

a plurality of impact absorbing members, each impact absorbing member including a protrusion and a bumper portion including a protrusion receiving cavity formed therein, the cavity having a shape and size that is complimentary to a shape and size of the protrusion of the impact absorbing member;

wherein the protrusion of each impact absorbing member of the plurality of impact absorbing members is received in the protrusion receiving cavity of another one of the plurality of impact absorbing members such that a column-receiving opening is formed through the plurality of impact absorbing members, and at least one protrusion of the protrusions that are received in the protrusion receiving cavities of the impact absorbing members is only partially received in the protrusion receiving cavity of a corresponding one of the plurality of impact absorbing members, and wherein the at least one partially received protrusion forms a resilient impact absorbing wall, the resilient impact absorbing wall defining a portion of the column-receiving opening.

2. The column protection apparatus of claim 1 wherein one or more of the impact absorbing members includes a strengthening rib on an outer surface thereof.

3. The column protection apparatus of claim 1 wherein each impact absorbing member of the plurality of impact absorbing members includes one or more grooves for receiving a portion of a securing strap.

4. The column protection apparatus of claim 1 wherein a top surface of each impact absorbing member of the plurality of impact absorbing members has a rounded shape.

5. The column protection apparatus of claim 1 wherein an outer surface of each impact absorbing member of the plurality of impact absorbing members has a rounded shape.

6. The column protection apparatus of claim 1 wherein each impact absorbing member of the plurality of impact absorbing members is substantially L-shaped.

7. The column protection apparatus of claim 1 wherein the impact absorbing members are formed from a high density polyethylene (HDPE) material.

8. The column protection apparatus of claim 1 wherein a thickness of the bumper portion of each impact absorbing member of the plurality of impact absorbing members is greater than a thickness of the protrusion of the impact absorbing member.

9. The column protection apparatus of claim 1 wherein an inner surface of the bumper portion of each impact absorbing member of the plurality of impact absorbing members extends along a length of the bumper portion from a top of the bumper portion to a bottom of the bumper portion and is shaped to conform to and lie adjacent to a corner of a column.

10. The column protection apparatus of claim 1 wherein the protrusion of each impact absorbing member of the plurality of impact absorbing members is configured to be spaced apart from a side of a column.

11. The column protection apparatus of claim 1 wherein the protrusion of each impact absorbing member of the plurality of impact absorbing members extends in a direction from a top of the impact absorbing member to a bottom of the impact absorbing member and extends along more than half of a length of the impact absorbing member.

12. The column protection apparatus of claim 1 wherein the protrusion receiving cavity of each impact absorbing member of the plurality of impact absorbing members extends in a direction from a top of the impact absorbing member to a bottom of the impact absorbing member and extends along more than half of a length of the impact absorbing member.

13. The column protection apparatus of claim 1 wherein the protrusion of each impact absorbing member of the plurality of impact absorbing members extends from and is statically affixed to the bumper portion such that the protrusion is prevented from moving relative to the bumper portion.

14. The column protection apparatus of claim 1 wherein the plurality of impact absorbing members includes four or more impact absorbing members.

15. The column protection apparatus of claim 1 wherein the protrusion of each impact absorbing member of the plurality of impact absorbing members includes a protrusion alignment member and the protrusion receiving cavity of each impact absorbing member of the plurality of impact absorbing members includes a cavity alignment member disposed inside of the protrusion receiving cavity and configured to interact with the protrusion alignment member to align the protrusion in the protrusion receiving cavity.

16. The column protection apparatus of claim 15 wherein the protrusion alignment member includes a ridge and the cavity alignment member includes a groove disposed in the cavity and configured to receive the ridge to align the protrusion in the protrusion receiving cavity.

* * * * *